United States Patent [19]

Schmidek

[11] Patent Number: 4,620,458

[45] Date of Patent: Nov. 4, 1986

[54] APPARATUS FOR SCREWING IN SET SCREWS, WHICH CAN BE OPERATED BY A WRENCH

[75] Inventor: Reinhard Schmidek, Würzburg, Fed. Rep. of Germany

[73] Assignee: Mero-Raumstruktur GmbH & Co., Würzburg, Fed. Rep. of Germany

[21] Appl. No.: 736,759

[22] Filed: May 22, 1985

[30] Foreign Application Priority Data

May 22, 1984 [DE] Fed. Rep. of Germany ... 8415532[U]

[51] Int. Cl.[4] ..... B25B 17/00

[52] U.S. Cl. ..... 81/57.28

[58] Field of Search ..... 81/57.12, 57.13, 57.28, 81/57.29, 451

[56] References Cited

U.S. PATENT DOCUMENTS

| | | | |
|---|---|---|---|
| 1,199,823 | 10/1916 | Sadtler | 81/57.29 |
| 1,325,407 | 12/1919 | Morgan | 81/57.29 |
| 3,696,694 | 10/1972 | Boro | 81/57.29 |
| 4,034,574 | 7/1977 | Kuder | 81/57.12 |

FOREIGN PATENT DOCUMENTS

| | | | |
|---|---|---|---|
| 1094629 | 4/1958 | Fed. Rep. of Germany | 81/451 |
| 1119464 | 4/1956 | France | 81/57.29 |

*Primary Examiner*—James L. Jones, Jr.

*Attorney, Agent, or Firm*—Quaintance, Murphy & Presta

[57] ABSTRACT

Screwing-in apparatus for set screws which can be operated by a wrench, for the connection of hollow rod elements with junction members of a framework, in which the junction members have threaded bores to receive the set screws and the rod elements have end members with middle bores for the passage of the shanks of the set screws. The heads of the set screws can be applied on inside shoulders of the end members for positioning. Other tubular elements are provided which extend inwardly from an opening in the wall of the rod element and open axially parallel to the middle bore in the end member and against it, in order to guide the drive elements of the screwing-in apparatus. A tubular, curved element forms a guide member for the screwing-in apparatus, in the rod element, in which a drive member or members are rotatable and axially immovable. The end of the tubular element which is turned away from the wrench is configured as a plug holder for the set screw.

8 Claims, 2 Drawing Figures

APPARATUS FOR SCREWING IN SET SCREWS, WHICH CAN BE OPERATED BY A WRENCH

BACKGROUND OF THE INVENTION

The present invention relates to an apparatus for screwing in set screws which can be operated by a wrench, for the connection of hollow rod elements with junction members of a framework structure, especially a space framework, in which junction members have threaded bores which are intended to receive set screws and the rod elements have end members with bores in the middle for fitting of the shanks of the set screws, of which the heads can be applied to inside shoulders of the end members for installation, and other tubular members are also provided, which extend inward from an opening in the wall of the rod element and each open axially and substantially parallel to the middle bore into their end members, in order to guide the drive members of the apparatus for screwing in.

It is known to fasten the rod elements to the junction members by means of set screws from German utility patent specification No. 83 25 005.0, in the manufacture of junction connections in framework structures of hollow rod elements and junction members. The set screws are inserted through side openings in the walls of the rod elements in tubular curved parts, which extend inwardly, axially parallel to a middle through-bore in the end member of the rod element, so that the screw shank can be forced through this middle bore and can be threaded into a threaded bore in the junction member. The curved tube parts are welded to the inside of the end members of the rod elements, and thus form one integral part with these rod elements.

For the threading in or tightening of a set screw guided in through such a tubular part, a screwdriver with a Phillips head is used, which can likewise be used for the threading in the tubular part. Furthermore, even before the assembly of the framework structure in the tubular guide parts, to arrange the stop or set screws so that they cannot be lost, it is already known to provide friction elements on the heads of these stop screws, which cooperate with the inside wall of the tubular guide parts, in order thus to prevent undesired release of the screws from the tubular guide parts. The tubular guide parts also serve to hold the stop screws.

The drawback of this known configuration resides particularly in that the rod elements are made more expensive by use of the tubular guide parts welded on both ends thereof, and during the assembly of the framework structure there is no possibility of rapidly and safely determining that the stop or set screws are also being threaded properly into the junction, in order to guarantee the required proper rod connection.

It is also already known, from German utility patent specification No. 83 04 465.5, to provide peepholes in the end members of the rod elements, in order to be able to determine whether the stop screws have also indeed been threaded to the required degree of threading. Such peepholes, however, of the size required for this monitoring, weaken the rod elements and make them even more expensive.

SUMMARY OF THE INVENTION

The present invention resides in an apparatus for screwing in set screws which can be operated by a wrench, for the connection of hollow rod elements with the junction members of a framework structure of a space framework, wherein the set screws can be fitted in the tubular guide parts which are welded into the rod elements without difficulty and with monitoring of the threaded bores of the junction members.

The invention solves this problem in that the tubular angled or bent element forms a guide part passing over into the rod element part of the screwing in apparatus, in which the drive member or members are mounted rotatably, but are axially fixed, and that the end of the tubular element turned away from the wrench instrument is configured as a plug-like holder for the set screws. A set screw can be guided into the rod element simply to the side through the opening in the wall of a rod element, by means of this apparatus for screwing it in, and can be moved through the middle bore into one of the end members of the rod element, so that with rotation of the drive member or members by means of the wrench, the set screw is threaded into the relevant threaded bore in the junction.

The screwing-in apparatus, therefore, facilitates a simple introduction of set screws into rod elements and also their threading into the threaded bores of the junction members with the aid of the wrench for the degree required for such a rod connection. The operator of the screwing-in apparatus can monitor the relative axial movement of the screwing-in apparatus relative to the rod element. The screwing-in apparatus can be used repeatedly and can be joined with the wrench either loosely or tightly as desired.

Another feature of the invention is that at the end of the tubular element turned toward the wrench there is provided a guide part which is determined for the installation with the outside of a rod element with a corresponding curved section. This guide part allows the alignment of the set screw on the middle bore in the relevant end member of the rod element as well as on the threaded bore in the junction member, and also allows the threading of the set screw into its stop position, wherein the guide part runs along the rod element and eliminates torque.

The drive members can also be configured as the two shafts of a miter gear. When each shaft of the miter gear is mounted in a bushing in the tubular element so that the bevel gears of the miter gear provided on one end of each shaft and in engagement with each other engage on the front ends of these bearing bushings, which are turned toward each other, then in very simple manner one advantageously attains the axial fixation of both shafts of the miter gear.

It is furthermore advantageous to provide one bearing bushing at some spacing from the opposite end of the tubular element, in order to configure the hollow space for the introduction of the head of a set screw.

Alternatively, the drive member can also consist of a flexible shaft.

Still another feature of the invention is that the drive members consist of two shafts connected by a universal joint.

The construction of one embodiment of the invention provides the advantage that the screwing-in apparatus can be easily fitted to rod elements with different outside diameters.

Another embodiment of the invention provides that different sizes of set screws could be threaded in with one and the same apparatus for screwing them in.

BRIEF DESCRIPTION OF THE DRAWINGS

The invention is more fully explained relative to the drawings of one exemplary embodiment. They show.

DESCRIPTION OF THE PREFERRED EMBODIMENT

Figure 1:
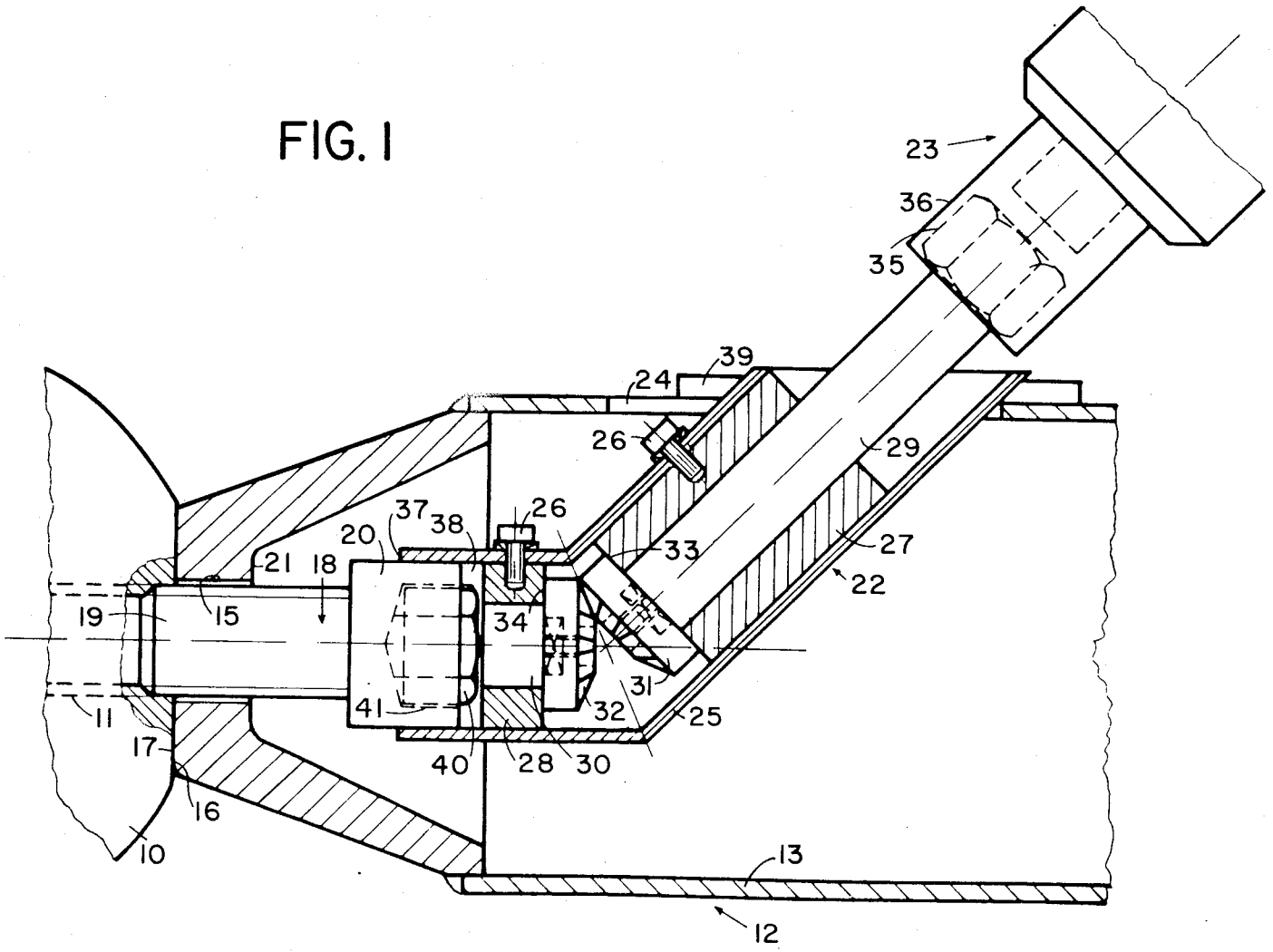
FIG. 1 is a side elevational view in section of the present apparatus in the area of the junction of a framework construction, with the screwing-in apparatus at the beginning of the threading process of a set screw into a threaded bore of a junction member.
Figure 2:
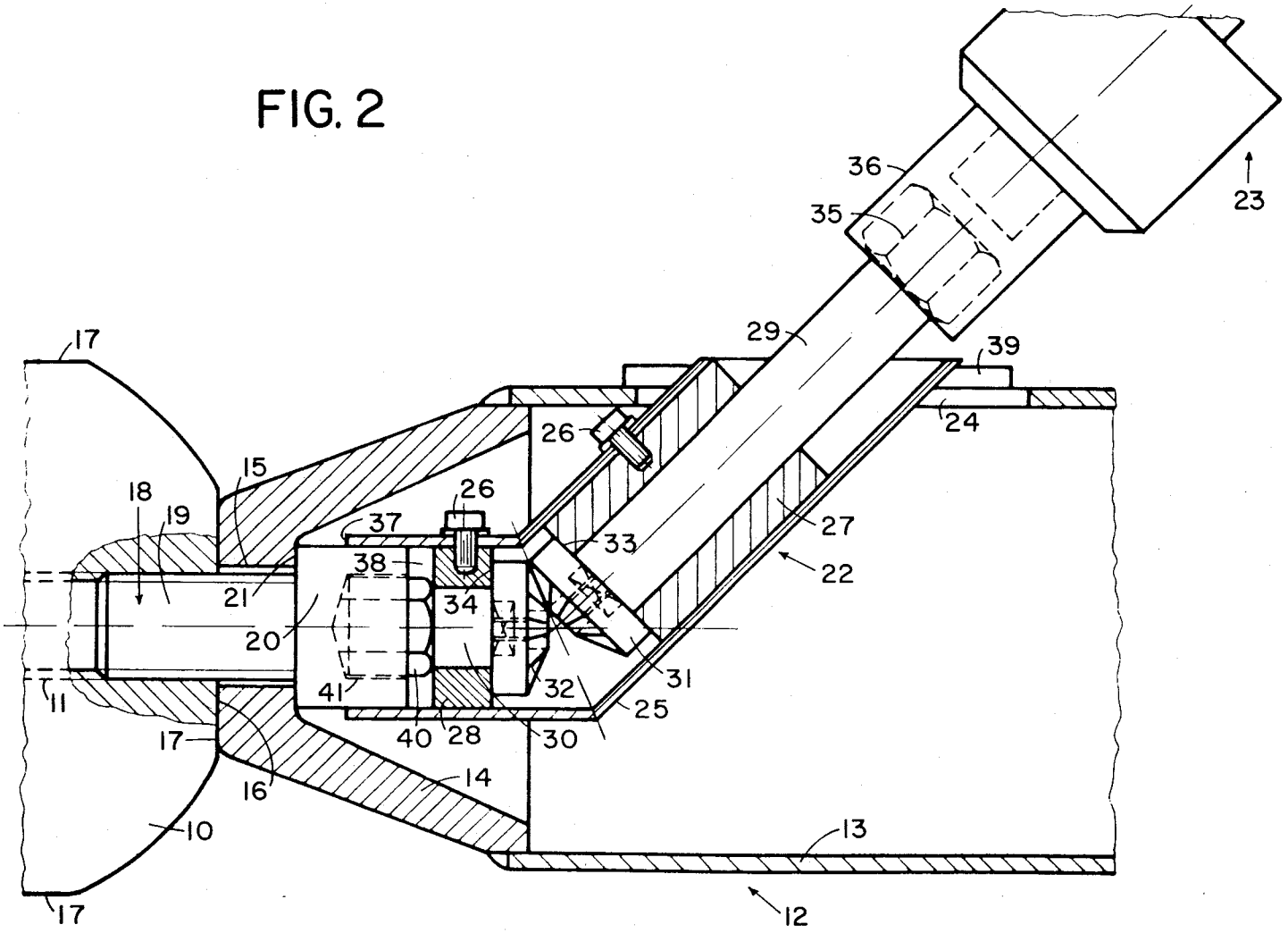
FIG. 2 is a view similar to that of FIG. 1, following the threading in of the set screw.

A part 10 of a junction of a space framework is indicated as having numerous threaded bores, of which the axes intersect in the midpoint of the junction and of which only one, 11, is indicated in FIGS. 1 and 2. The hollow rod elements 12 of the space framework, which are to be attached by their ends at different spaced positions in the junction 10, each consist of a tubular part 13, at both ends of which are welded on truncated conical end members 14. Each end member 14 has a middle bore 15 as well as a flat contact surface 16, which is pressed against a corresponding flat surface 17 on junction member 10 for the completed rod connection.

Set screws 18 serve to connect the ends of each rod element 12 to two junction members 10. The shanks 19 of these set screws 18 extend with slight radial play through the middle bores 15 of end members 14 and are each threaded sufficiently into one of the threaded bores 11 in junction 10 during complete rod connection (FIG. 2), so that the head 20 of these screws engages on an inside shoulder 21 of end member 14. As an exemplary embodiment, the set screws 18 may be so-called inside hexagon head screws.

For the introduction of set screws 18 in their threading position within rod element 12, as well as for the threading of the same into threaded bores 11 of junction 10, screwing-in apparatus 22 is used, which can be joined for their drive with a customary electro-rotary socket wrench 23 or other suitable tool. This screwing-in apparatus 22 can be inserted into the hollow space of the rod element through assembly openings 24 at both ends of rod element 12. The screwing-in apparatus 22 in the exemplary embodiment has bent tubular element 25. In both arms of this tubular element 25 are found bearing bushings 27 and 28, fastened e.g. by means of screws 26 for shafts 29 and 30 of a miter gear. Bevel gears 31, 32 are arranged nonrotatably on the ends of shafts 29 and 30, turned toward each other, where they engage with each other. The arrangement is also so that these bevel gears 31, 32 engage on the ends 33, 34 of bear bushings 27 and 28 which are turned toward each other. Shaft 29 of the miter gear is provided on its outside free end with a hexagon head screw 35, which can be inserted fitting into the corresponding chuck 36 of wrench 23. Bearing bushing 28 is arranged at a certain distance from the end 37 of tubular element 25, so that a hollow space 38 is created, into which the head 29 of screw 18 can be inserted and fitted. This end of tubular element 25 in other words forms a plug-like holder for set screws 18 upon the introduction of the same into screwed-in position as shown in FIG. 1.

The introduction and alignment of shank 19 of the set screw in passage bore 15 and threaded bore 11 is thus facilitated, in that a guide part 39 is found on the longer arm of tubular element 25, which is intended for the wedge-fitting with the outside of rod element 12. This guide part 39 has a curve fitted to the radius of tubular part 13 and is longer than assembly opening 24. Guide part 39 also controls the axial movement of the screwing-in apparatus 22 during threading of set screw 18 into a threaded bore 11 of junction 10.

In order to thread in a set screw 18, it is first introduced into hollow space 38 of tubular element 25, and then is guided through assembly opening 24 into the hollow space of rod element 12, until guide part 39 engages on the outside wall of rod element 12. In this state, set screw 18 is aligned in passage bore 15 and threaded bore 11 and following the thrust of shank 19 through bore 15, screw 18 can be threaded into threaded bore 11. For this purpose, wrench 23 is coupled with screwing-in apparatus 22 during operation and set screw 18 is tightened by the miter gear, for the creation of a rod connection. On the outside ends of shaft 30 of the miter gear, a hexagon head screw 40 is provided, which engages tightly in the inside hexagon head screw 41 in head 20 of screw 18, and transmits the rotation of the miter gear to screw 18.

When the threading process of set screw 18 is terminated, which is indicated to the operator of the screwing-in apparatus by a certain axial movement of guide part 39 relative to rod element 12, then the screwing-in apparatus 22 is simply withdrawn from head 20 of threaded-in screw 18 and removed from rod element 12 through assembly opening 24.

What is claimed is:

1. Screwing-in apparatus for set screws which can be operated by a wrench, for the connection of hollow rod elements with junction members of a framework, in which the junction members have threaded bores to receive the set screws and the rod elements have end members with middle bores for the passage of the shanks of the set screws, of which the heads can be applied on inside shoulders of the end members for positioning, and a tubular element is provided, which extends inwardly from an opening in the wall of the rod element and opens axially parallel to the middle bore in the end member, in order to guide drive elements of the screwing-in apparatus disposed therein, characterized in that a tubular curved element (25) forms a guide member for the screwing-in apparatus (22), in the rod element (12), in which drive means are rotatable and axially immovable, in that the inner end of the tubular element (25) is configured as a plug holder for the set screw (18), and in that a guide part (39) with a curved section corresponding to the exterior surface of the rod element (12) is mounted on the outer end of tubular element (25), said guide part being engagable with the exterior surface of the rod element and being slidable thereon to align the set screw (18) with the end member bore and threaded bore in the junction member.

2. Screwing-in apparatus as in claim 1, characterized in that the drive means are formed by the two shafts (29,30) of a miter gear.

3. Screwing-in apparatus as in claim 2, characterized in that each shaft (29, 30) of the miter gear is mounted in a bearing bushing (27, 28) in tubular element (25) so that bevel gears (31, 32) of the miter gear which are provided on one end of each shaft (27, 28) and are in engagement with each other engage on the end (33, 34) of the bearing bushings (27, 28) which are turned toward each other.

4. Screwing-in apparatus as in claim 3, characterized in that one bearing bushing (28) is arranged at a predetermined distance from that opposite end (37) of the tubular element (25).

5. Screwing-in apparatus in claim 1, characterized in that the drive means is a flexible shaft.

6. Screwing-in apparatus as in claim 1, characterized in that the drive means are two shafts connected by a universal joint.

7. Screwing-in apparatus as in claim 1, characterized in that guide part (39) is adjustably mounted on tubular element (25) so that its height can be varied.

8. Screwing-in apparatus as in claim 1, characterized in that adapters of different sizes are insertable into tubular element (25) to hold the set screws (18).

* * * * *